US006109038A

United States Patent [19]

Sharifi et al.

[11] Patent Number: 6,109,038

[45] Date of Patent: Aug. 29, 2000

[54] COMBUSTOR WITH TWO STAGE PRIMARY FUEL ASSEMBLY

[75] Inventors: Mehran Sharifi, Winter Springs; Wendel Zolyomi, Oviedo; Graydon Lane Whidden, Orlando, all of Fla.

[73] Assignee: Siemens Westinghouse Power Corporation, Orlando, Fla.

[21] Appl. No.: 09/010,021

[22] Filed: Jan. 21, 1998

[51] Int. Cl.[7] ..... F02C 9/20

[52] U.S. Cl. ..... 60/737; 60/739; 60/742; 431/284

[58] Field of Search ..... 60/737, 739, 742, 60/748, 261; 431/284

[56] References Cited

U.S. PATENT DOCUMENTS

| | | | |
|---|---|---|---|
| 2,951,341 | 9/1960 | Henning, Jr. et al. | 60/739 |
| 2,979,899 | 4/1961 | Salmon et al. | 60/261 |
| 3,151,453 | 10/1964 | Lefebvre et al. | 60/739 |
| 3,213,523 | 10/1965 | Boehler | 60/739 |
| 4,047,877 | 9/1977 | Flanagan | 60/739 |
| 4,100,733 | 7/1978 | Striebel et al. | 60/39.74 |
| 4,141,213 | 2/1979 | Ross | 60/39.67 |
| 4,455,840 | 6/1984 | Matt et al. | 60/737 |
| 4,499,735 | 2/1985 | Moore et al. | 60/739 |
| 5,097,666 | 3/1992 | Shekleton et al. | 60/737 |
| 5,101,633 | 4/1992 | Keller et al. | 60/737 |
| 5,165,224 | 11/1992 | Spadaccini et al. | 60/39.02 |
| 5,228,283 | 7/1993 | Sciocchetti | 60/39.05 |
| 5,251,447 | 10/1993 | Joshi et al. | 60/737 |
| 5,319,935 | 6/1994 | Toon et al. | 60/733 |
| 5,323,614 | 6/1994 | Tsukahara et al. | 60/737 |
| 5,359,847 | 11/1994 | Pillsbury et al. | 60/39.06 |
| 5,361,586 | 11/1994 | McWhirter et al. | 60/737 |
| 5,475,979 | 12/1995 | Oag et al. | 60/737 |
| 5,479,782 | 1/1996 | Parker et al. | 60/747 |
| 5,505,045 | 4/1996 | Lee et al. | 60/748 |
| 5,640,851 | 6/1997 | Toon et al. | 60/737 |
| 5,647,215 | 7/1997 | Sharifi et al. | 60/737 |
| 5,983,642 | 11/1999 | Parker et al. | 60/737 |

FOREIGN PATENT DOCUMENTS

| | | |
|---|---|---|
| 0540167 | 5/1993 | European Pat. Off. . |
| 0620402 A1 | 10/1994 | European Pat. Off. . |
| 0778443 | 6/1997 | European Pat. Off. . |

*Primary Examiner*—Ted Kim

*Attorney, Agent, or Firm*—Eckert Seamans Cherin & Mellott, LLC

[57] ABSTRACT

A combustor for a gas turbine having first and second passages for pre-mixing primary fuel and air supplied to a primary combustion zone. The flow of fuel to the first and second pre-mixing passages is separately regulated using a single annular fuel distribution ring having first and second row of fuel discharge ports. The interior portion of the fuel distribution ring is divided by a baffle into first and second fuel distribution manifolds and is located upstream of the inlets to the two pre-mixing passages. The annular fuel distribution ring is supplied with fuel by an annular fuel supply manifold, the interior portion of which is divided by a baffle into first and second fuel supply manifolds. A first flow of fuel is regulated by a first control valve and directed to the first fuel supply manifold, from which the fuel is distributed to first fuel supply tubes that direct it to the first fuel distribution manifold. From the first fuel distribution manifold, the first flow of fuel is distributed to the first row of fuel discharge ports, which direct it into the first pre-mixing passage. A second flow of fuel is regulated by a second control valve and directed to the second fuel supply manifold, from which the fuel is distributed to second fuel supply tubes that direct it to the second fuel distribution manifold. From the second fuel distribution manifold, the second flow of fuel is distributed to the second row of fuel discharge ports, which direct it into the second pre-mixing passage.

17 Claims, 5 Drawing Sheets

COMBUSTOR WITH TWO STAGE PRIMARY FUEL ASSEMBLY

REFERENCE TO GOVERNMENT CONTRACTS

Development for this invention was supported in part by a U.S. Department of Energy contract. Accordingly, the United States government may have certain rights in the invention, including a paid-up license in this invention and the right in limited circumstances to require the patent owner to license others on reasonable terms as may be provided for by the terms of contract DE-FC21-95MC32267 awarded by the Department of Energy.

BACKGROUND OF THE INVENTION

The present invention relates to a combustor for burning fuel in compressed air. More specifically, the present invention relates to a combustor in which fuel is introduced into two pre-mixing passages by a single fuel distribution ring.

In a gas turbine, fuel is burned in compressed air, produced by a compressor, in one or more combustors. Traditionally, such combustors had a primary combustion zone in which an approximately stoichiometric mixture of fuel and air was formed and burned in a diffusion type combustion process. Additional air was introduced into the combustor downstream of the primary combustion zone. Although the overall fuel/air ratio was considerably less than stoichiometric, the fuel/air mixture was readily ignited at start-up and good flame stability was achieved over a wide range of firing temperatures due to the locally richer nature of the fuel/air mixture in the primary combustion zone.

However, use of such approximately stoichiometric fuel/air mixtures resulted in very high temperatures in the primary combustion zone. Such high temperatures promoted the formation of oxides of nitrogen ("NOx"), considered an atmospheric pollutant. It is known that combustion at lean fuel/air ratios reduces NOx formation. However, achieving such lean mixtures requires that the fuel be widely distributed and very well mixed into the combustion air. This can be accomplished by introducing the fuel into the combustion air in a number of annular pre-mixing passages so that the fuel and air are pre-mixed prior to their introduction into the combustion zones. According to one approach, the fuel is introduced into each pre-mixing passage by separate fuel manifold rings around which fuel discharge ports are distributed and that are disposed adjacent the passage inlets, as shown in U.S. Pat. No. 5,361,586 (McWhirter et al.). Although this approach allows the flow of fuel to each passage to be individually controlled, unfortunately, it results in considerable blockage of the flow area for the combustion air.

Alternatively, fuel can be introduced into two pre-mixing passages by elongate fuel spray tubes, or "pegs," each of which discharges fuel into both passages. A combustor of this type is shown in U.S. Pat. No. 5,479,782 (Parker et al.), hereby incorporated by reference in its entirety. Although such an approach can reduce the blockage of the combustion air flow area, unfortunately, it does not allow the amount of fuel introduced into each of the pre-mixing passages to be individually regulated. This lack of control prevents optimization of the combustion dynamics and can result in excessive combustion instability and noise.

It is therefore desirable to provide a combustor, such as that suitable for use in a gas turbine, in which the flow of fuel to multiple pre-mixing passages can be individually controlled without excessively blocking the combustion air flow area.

SUMMARY OF THE INVENTION

Accordingly, it is the general object of the current invention to provide a combustor, such as that suitable for use in a gas turbine, in which the flow of fuel to multiple pre-mixing passages can be individually controlled without excessively blocking the combustion air flow area.

Briefly, this object, as well as other objects of the current invention, is accomplished in a combustor for combusting a flow of fuel in a flow of oxygen bearing fluid, such as compressed air. The combustor includes (i) first and second passages for mixing first and second portions of the fuel flow in first and second portions of the flow of oxygen bearing fluid, respectively, and (ii) means for introducing the fuel flow into the first and second portions of the flow of oxygen bearing fluid. The fuel introducing means comprises an annular fuel distribution ring having an interior portion forming first and second fuel distribution manifolds. The first fuel distribution manifold has means for discharging the first portion of the fuel flow into the first passage, while the second fuel distribution manifold has means for discharging the second portion of the fuel flow into the second passage. In a preferred embodiment of the current invention, the combustor also includes means for separately regulating the flow rate of the first portion of the fuel flow discharged by the first fuel distribution manifold and the flow rate of the second portion of the fuel flow discharged by the second fuel distribution manifold.

In one embodiment, the combustor also includes an annular fuel supply ring in flow communication with the annular fuel distribution ring. The annular fuel supply ring has an interior portion forming first and second fuel supply manifolds. The fuel introducing means further includes means for directing the first portion of the fuel flow from the first fuel supply manifold to the first fuel distribution manifold, and means for directing the second portion of the fuel flow from the second fuel supply manifold to the second fuel distribution manifold.

DESCRIPTION OF THE PREFERRED EMBODIMENT

Figure 1:
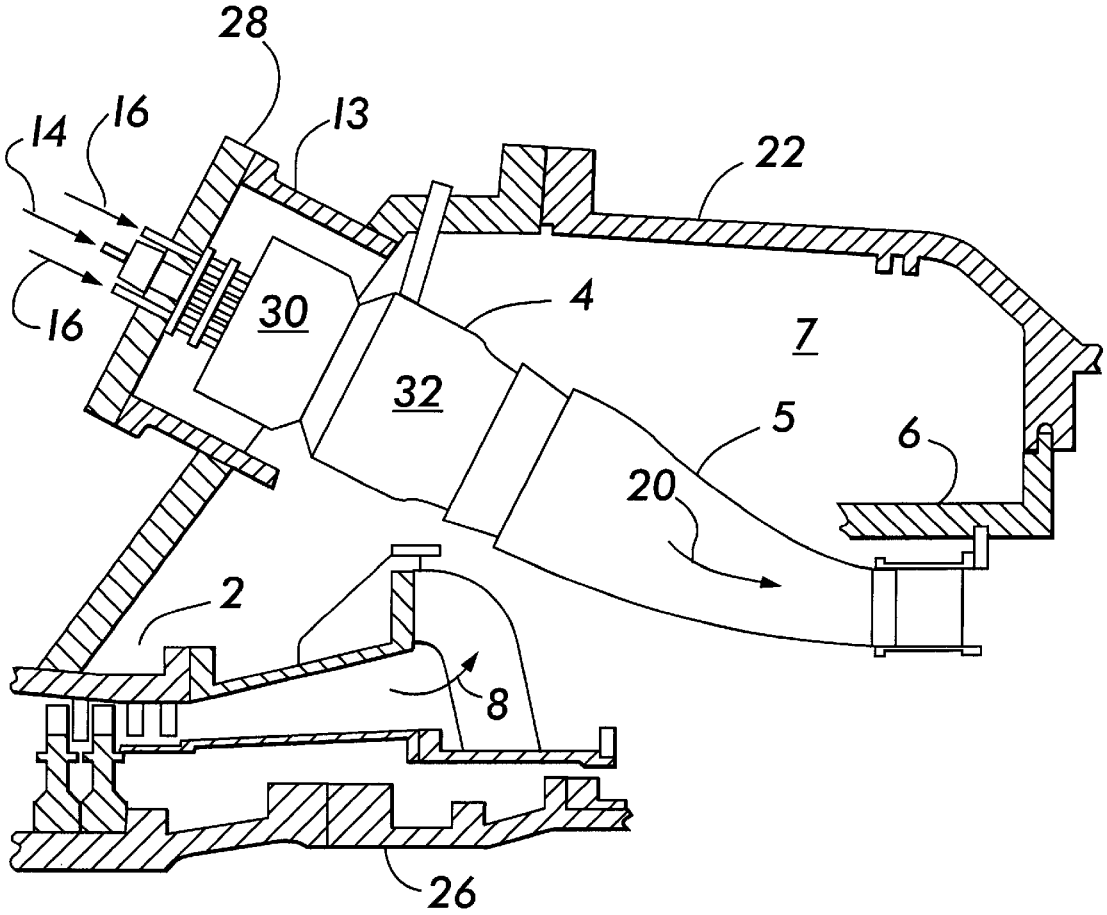
FIG. 1 is a longitudinal cross-section, partially schematic, through the combustion section of a gas turbine.

Referring to the drawings, there is shown in FIG. 1 the combustion section of a gas turbine. As is conventional, the gas turbine is comprised of a compressor 2 that is driven by a turbine 6 via a shaft 26. Ambient air is drawn into the compressor 2 and compressed. The compressed air 8 produced by the compressor 2 is directed to a combustion system that includes one or more combustors 4 disposed within a chamber 7 formed by a cylindrical shell 22. In the combustors 4, gaseous or liquid fuel is burned in the compressed air 8, thereby producing a hot compressed gas 20. Each combustor has a primary zone 30 and a secondary zone 32. The hot compressed gas 20 produced by the combustor 4 is directed to the turbine 6 by a duct 5 where it is expanded, thereby producing shaft horsepower for driving the compressor 2, as well as a load, such as an electric generator. The expanded gas produced by the turbine 6 is exhausted, either to the atmosphere directly or, in a combined cycle plant, to a heat recovery steam generator and then to atmosphere.

The primary zone 30 of the combustor 4 is supported by a support plate 28. The support plate 28 is attached to a cylinder 13 that extends from the shell 22 and encloses the primary zone 30. The secondary zone 32 is supported by arms (not shown) extending from the support plate 28. Separately supporting the primary and secondary zones 30 and 32 reduces thermal stresses due to differential thermal expansion.

Figure 2:
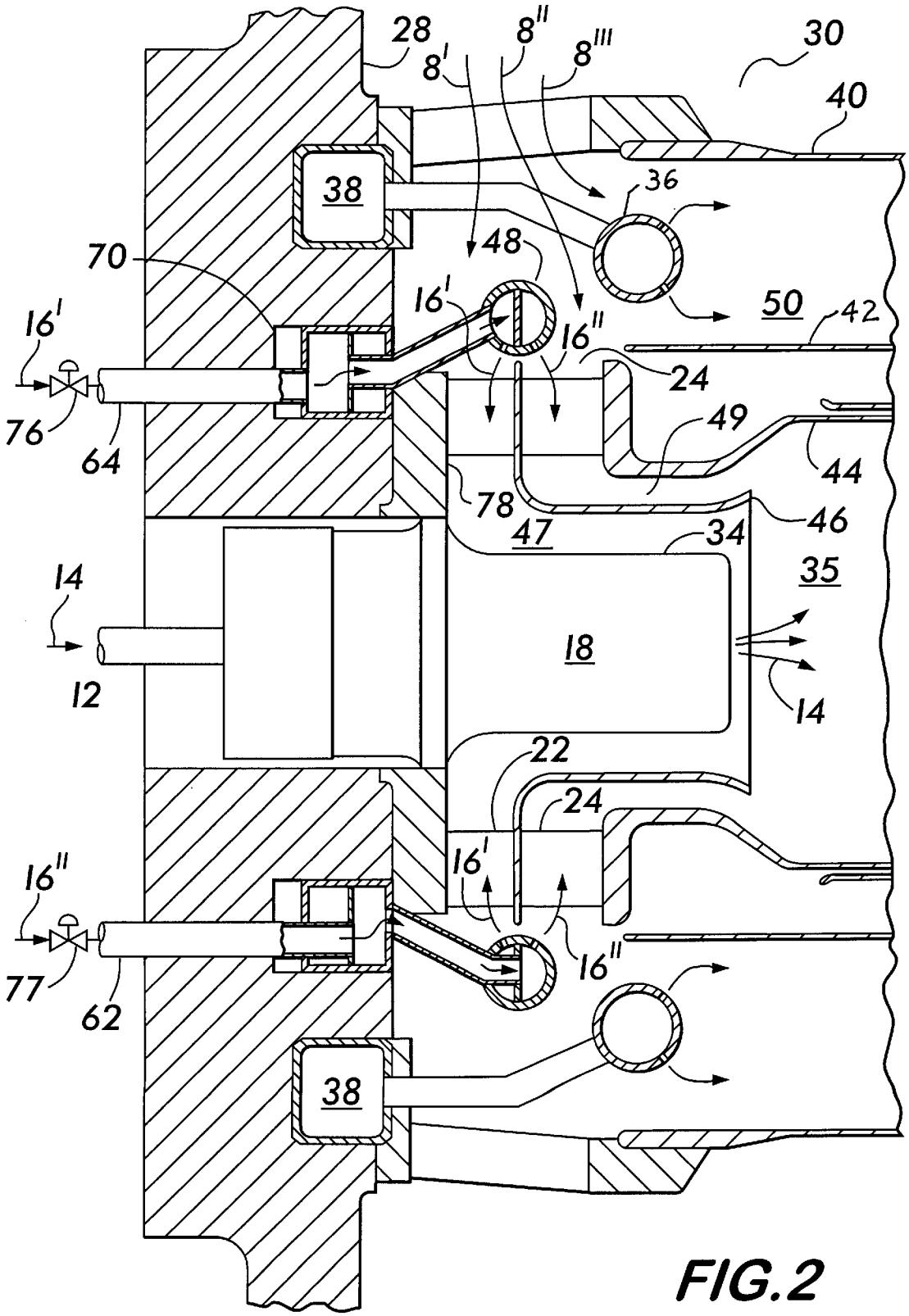
FIG. 2 is a longitudinal cross-section through the primary section of the combustor shown in FIG. 1.

Referring to FIG. 2, a primary combustion zone 35, in which a lean mixture of fuel and air is burned, is located within the primary zone 30 of the combustor 4. Specifically, the primary combustion zone 35 is enclosed by a cylindrical inner liner 44. The inner liner 44 is encircled by a cylindrical middle liner 42 that is, in turn, encircled by a cylindrical outer liner 40. The liners 40, 42 and 44 are concentrically arranged so that an annular secondary pre-mixing passage 50 is formed between the middle and outer liners 42 and 30, respectively. Secondary gas fuel is directed from a manifold 38 to an annular secondary gas fuel ring 36 that distributes gaseous fuel around the inlet to passage 50 and into secondary combustion air 8'''. The fuel/air mixture produced by the secondary pre-mixing passage 50 is directed to a secondary combustion zone (not shown).

A fuel nozzle 18 is centrally disposed within the primary zone 30 and is supplied with oil fuel 14. In addition, the fuel nozzle 18 may be supplied with gaseous fuel and/or water for additional NOx control.

Compressed air from the compressor 2 is introduced into the primary combustion zone 35 by a primary air inlet formed in the front end of the primary zone 30. As shown in FIG. 2, the primary air inlet is formed by first and second annular primary pre-mixing passages 47 and 49 that divide the incoming air into two streams 8' and 8". The first primary pre-mixing passage 47 has an upstream radial portion and a downstream axial portion. The upstream portion of the first passage 47 is formed between a radially extending circular plate 78 and the radially extending wall of a flow guide 46. The downstream portion of passage 47 is formed between the flow guide 46 and the outer sleeve 34 of the fuel nozzle 18 and is encircled by the second passage 49.

The second primary pre-mixing passage 49 also has an upstream radial portion and a downstream axial portion. The upstream portion of second passage 49 is formed between the radially extending wall of the flow guide 46 and a radially extending portion of the inner liner 44. The downstream portion of second passage 49 is formed between the axial portion of the flow guide 46 and an axially extending portion of the inner liner 44.

A number of swirl vanes 22 and 24 are distributed around the circumference of the upstream portions of the primary pre-mixing passages 47 and 49. The swirl vanes 22 in the inlet of the first passage 47 impart a counterclockwise (when viewed in the direction of the axial flow) rotation to the air stream 8'. The swirl vanes 24 in the inlet of second passage 49 impart a clockwise rotation to the air stream 8". The swirl imparted by the vanes 22 and 24 to the air streams 8' and 8" ensures good mixing between fuel 16' and 16" and the air, thereby eliminating locally fuel rich mixtures and the associated high temperatures that increase NOx generation.

The primary fuel assembly serves to introduce fuel 16, which is preferably gaseous, into the first and second primary pre-mixing passages 47 and 49. As shown in FIG. 2, and shown in more detail in FIGS. 3–5, the primary fuel assembly comprises a circumferentially extending, tubular annular fuel distribution ring 48 located immediately upstream of the inlets to the primary pre-mixing passages 47 and 49. Preferably, the fuel distribution ring 48 is located immediately adjacent, and centered above, the radially extending wall of the flow guide 46 that separates the pre-mixing passages.

Figure 3:
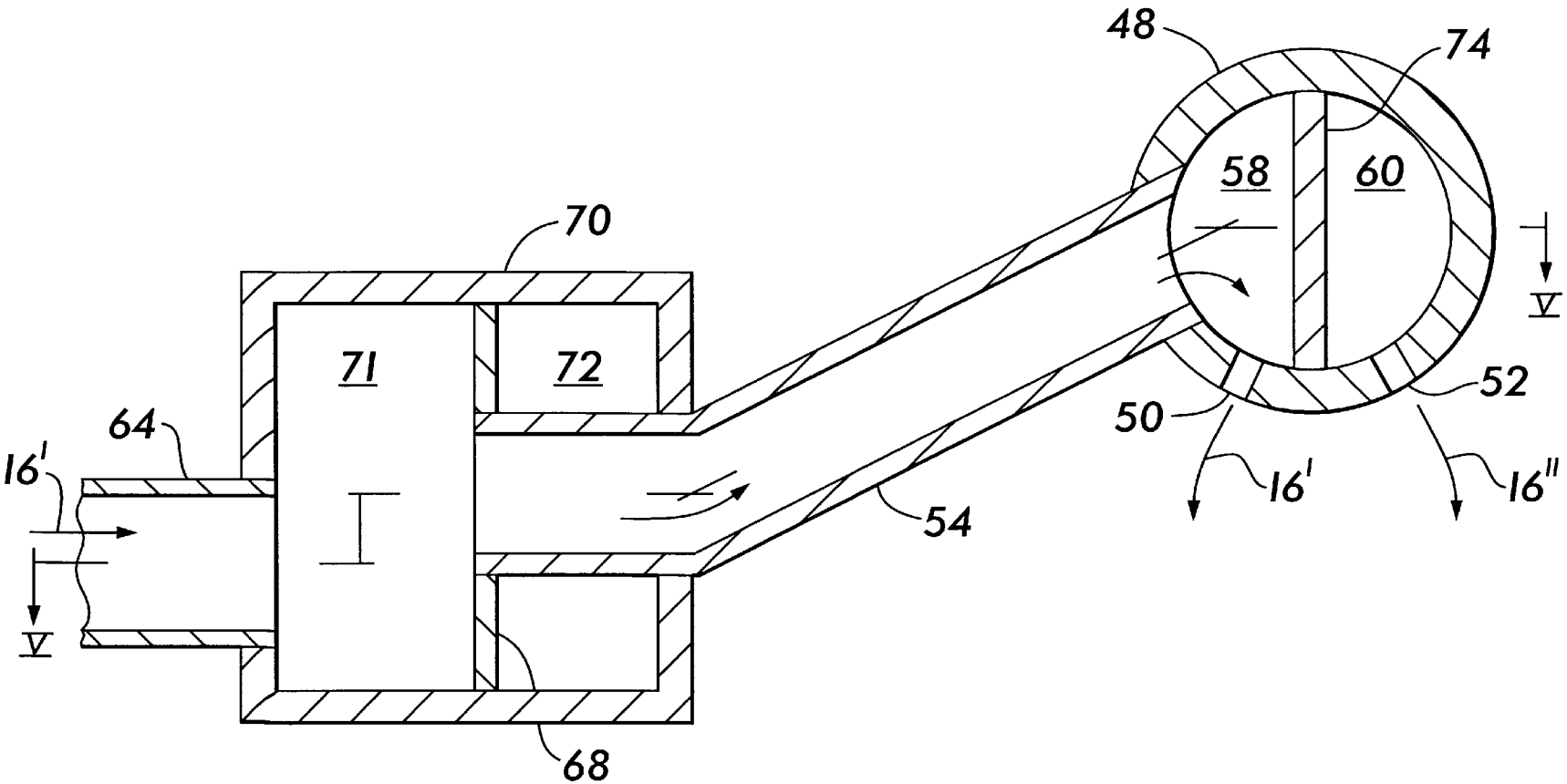
FIG. 3 is a detailed view of the portion of the primary fuel assembly shown in upper portion of FIG. 2.
Figure 4:
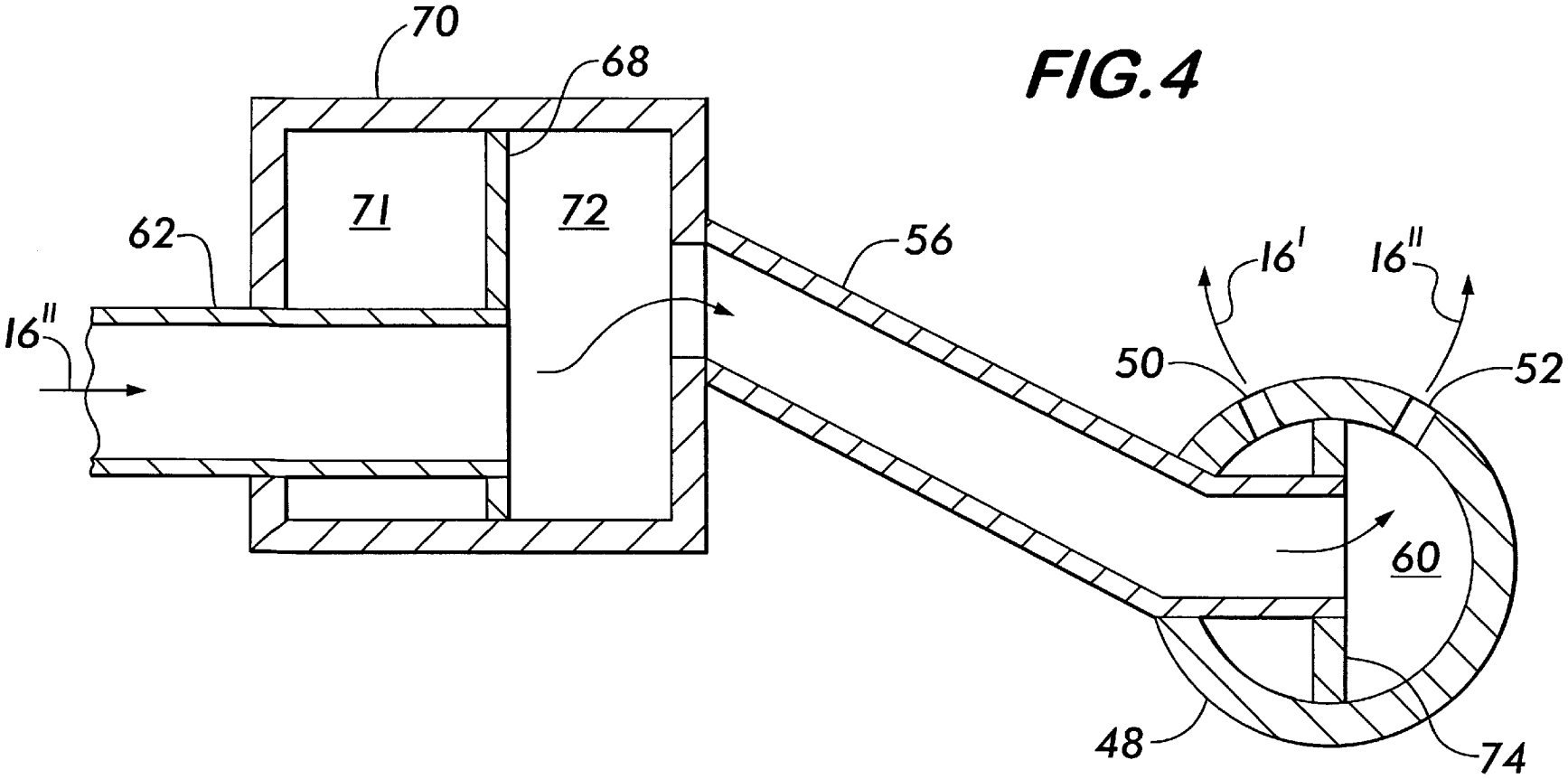
FIG. 4 is a detailed view of the portion of the primary fuel assembly shown in lower portion of FIG. 2.
Figure 5:
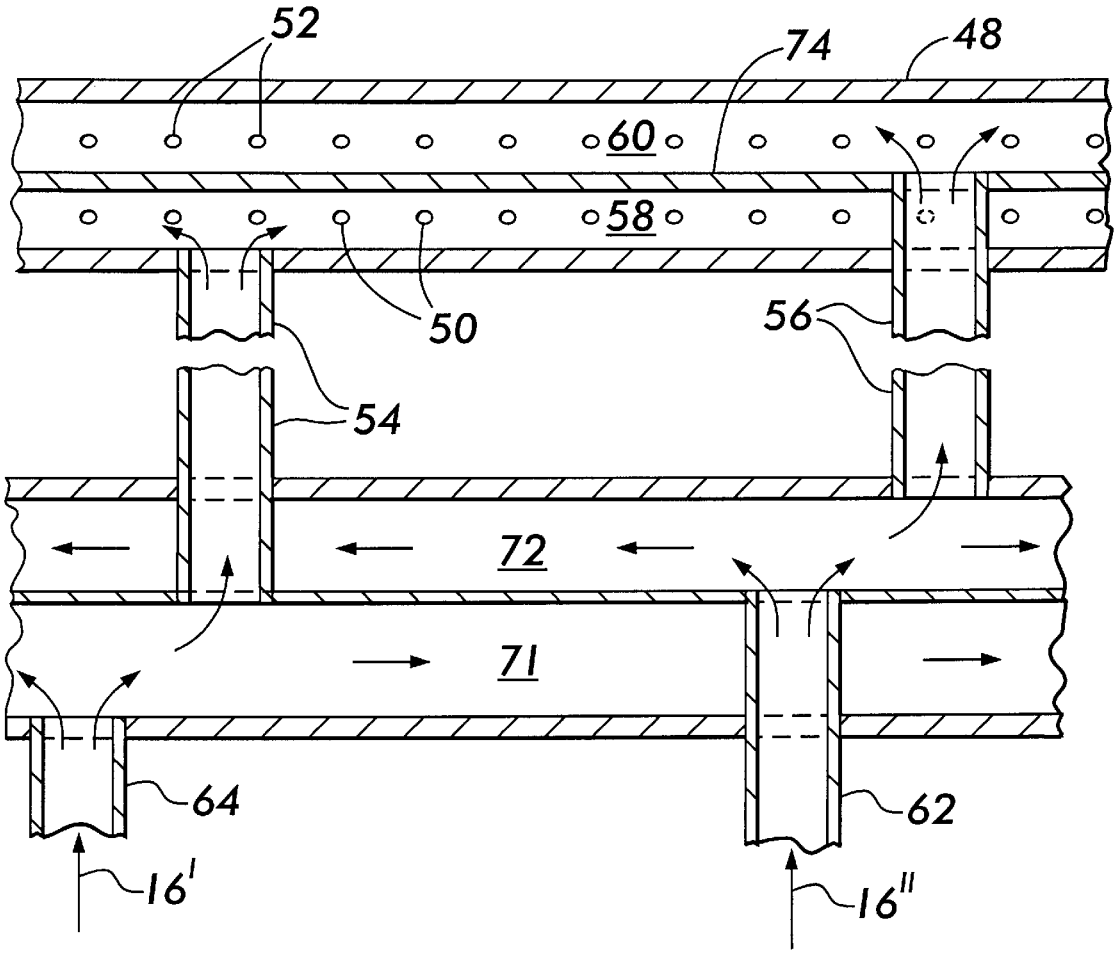
FIG. 5 is a cross-section, partially schematic, taken through line V—V shown in FIG. 3.

As shown best in FIGS. 3–5, first and second rows of spaced, radially inward facing fuel discharge ports 50 and 52, respectively, extend around the circumference of the fuel distribution ring 48. As a result of the placement of the fuel distribution ring 48, as discussed above, the first row of fuel discharge ports 50 is disposed upstream of the first fuel pre-mixing passage 47, while the second row of fuel discharge ports 52 is disposed upstream of the second fuel pre-mixing passage 49. Consequently, fuel discharge ports 50 supply fuel 16' to only the first pre-mixing passage 47, while fuel discharge ports 52 supply fuel 16" to only the second pre-mixing passage 49.

The interior portion of the fuel distribution ring 48 forms an annular chamber that is divided by a circumferentially extending baffle 74 into first and second fuel distribution manifolds 58 and 60, respectively. The first fuel distribution manifold 58 supplies fuel 16' to the fuel discharge ports 50 for the first pre-mixing passage 47, while the second fuel distribution manifold 60 supplies fuel 16" to the fuel discharge ports 52 for the second pre-mixing passage 49.

As also shown in FIGS. 2–5, the primary fuel distribution ring 48 is supplied with fuel 16 by a circumferentially extending annular fuel supply ring 70 disposed within the support plate 28. As shown best in FIGS. 3–5, the interior portion of the fuel supply ring 70 forms an annular chamber that is divided by a circumferentially extending baffle 68 so as to form two fuel supply manifolds 71 and 72. As shown in FIG. 2, separate fuel supply pipes 62 and 64 supply separate streams of fuel 16" and 16', respectively, to the fuel supply manifolds 71 and 72, respectively. Control valves 76 and 77 are installed in each of the fuel pipes 62 and 64 so that the flow rate of fuel 16' and 16" can be separately regulated.

As shown best in FIGS. 3 and 5, fuel supply tubes 54 extend from the first fuel supply manifold 71, through the baffle 68 in the fuel supply ring 70, through fuel supply manifold 72, through the fuel distribution ring 48, and into the first fuel distribution manifold 58. Thus, fuel supply tubes 54 supply fuel 16' to from the first fuel supply manifold 71 to the first fuel distribution manifold 58. As shown best in FIGS. 4 and 5, fuel supply tubes 56 extend from the second fuel supply manifold 72 through the fuel distribution ring 48, through the first fuel distribution manifold 58, through the baffle 74, and into the second fuel distribution manifold 60. Thus fuel supply tubes 56 supply fuel 16" from the second fuel supply manifold 72 to the second fuel distribution manifold 60.

As shown best in FIG. 5, the complete fuel path through the primary fuel assembly is as follows. The flow of fuel 16', which is regulated by control valve 76, is directed by supply pipe 64 to the fuel supply manifold 71 formed within the fuel supply ring 70. From the fuel supply manifold 71, the fuel 16' is distributed to fuel supply tubes 54 that direct the fuel to fuel distribution manifold 58 formed within the fuel distribution ring 48. From the fuel distribution manifold 58, the fuel 16' is distributed to the fuel discharge ports 50, which direct the fuel into the first pre-mixing passage 47.

The flow of fuel 16", which is regulated by control valve 77, is directed by supply pipe 62 to the fuel supply manifold 72 formed within the fuel supply ring 70. From the fuel supply manifold 72, the fuel 16" is distributed to fuel supply tubes 56 that direct the fuel to fuel distribution manifold 60 formed within the fuel distribution ring 48. From the fuel distribution manifold 60, the fuel 16" is distributed to the fuel discharge ports 52, which direct the fuel into the second pre-mixing passage 49.

The configuration of the primary fuel assembly of the current invention has several advantages. First, since a single fuel distribution ring 48 supplies streams 16' and 16" of fuel to both of the primary pre-mixing passages 47 and 49, the obstruction of the flow area of the pre-mixing passages is minimized.

Second, since fuel distribution manifolds 58 and 60 are supplied with fuel 16' and 16" from separate supply manifolds 71 and 72 to which the flow of fuel is separately controlled by valves 76 and 77, the fuel/air ratios in the two pre-mixing passages 47 and 49 can be individually controlled to optimize the combustion in the primary combustion zone 35.

The present invention may be embodied in other specific forms without departing from the spirit or essential attributes thereof and, accordingly, reference should be made to the appended claims, rather than to the foregoing specification, as indicating the scope of the invention.

What is claimed is:

1. A combustor for combusting a flow of fuel in a flow of oxygen bearing fluid comprising:

a) first and second passages for mixing first and second portions of said fuel flow in first and second portions of said flow of oxygen bearing fluid, respectively, said first passage having an inlet for receiving said first portion of said oxygen bearing fluid flow, said second passage having an inlet for receiving said second portion of said oxygen bearing fluid flow wherein said first and second passages are separated by a wall member; and b) means for introducing said fuel flow into said first and second portions of said flow of oxygen bearing fluid, said fuel introducing means comprising an annular fuel distribution chamber positioned in the flow of oxygen bearing fluid upstream of said wall member and forming first and second, separate fuel distribution manifolds, which are isolated from each other, said first fuel distribution manifold having means for discharging said first portion of said fuel flow substantially only into said first passage and said first portion of said flow of oxygen bearing fluid, and said second fuel distribution manifold having means for discharging said second portion of said fuel flow substantially only into said second passage and said second portion of said flow of oxygen bearing fluid.

2. The combustor according to claim 1, further comprising means for separately regulating the flow rate of said first portion of said fuel flow discharged by said first fuel distribution manifold and the flow rate of said second portion of said fuel flow discharged by said second fuel distribution manifold.

3. The combustor according to claim 1, further comprising:

a) an annular fuel distribution ring, the interior of said ring forming said annular fuel distribution chamber; and b) a circumferentially extending baffle dividing said chamber into said first and second fuel distribution manifolds.

4. The combustor according to claim 1, further comprising an annular fuel distribution ring, the interior of said ring forming said annular fuel distribution chamber, and wherein said means for discharging said first portion of said fuel flow into said first passage comprises a plurality of first ports distributed around said fuel distribution ring, and wherein said means for discharging said second portion of said fuel flow into said second passage comprises a plurality of second ports distributed around said fuel distribution ring.

5. The combustor according to claim 4, wherein said first and second fuel discharge ports are arranged in first and second rows, respectively, extending around the circumference of said fuel distribution ring.

6. The combustor according to claim 1, wherein said fuel introducing means further comprises an annular fuel supply chamber in flow communication with said annular fuel distribution chamber.

7. The combustor according to claim 6, wherein said annular fuel supply chamber forms first and second fuel supply manifolds, and wherein said fuel introducing means further comprises means for directing said first portion of said fuel flow from said first fuel supply manifold to said first fuel distribution manifold and means for directing said second portion of said fuel flow from said second fuel supply manifold to said second fuel distribution manifold.

8. The combustor according to claim 7, wherein said annular fuel supply chamber further comprises a circumferentially extending baffle dividing said interior of said fuel supply chamber into said first and second fuel supply manifolds.

9. The combustor according to claim 7, wherein said means for directing said first portion of said fuel flow to said first fuel distribution manifold comprises a first fuel tube extending between said first fuel supply manifold and said first fuel distribution manifold, and wherein said means for directing said second portion of said fuel flow to said second distribution manifold comprises a second fuel tube extending between said second fuel supply manifold and said second fuel distribution manifold.

10. The combustor according to claim 1, wherein said annular fuel distribution chamber is formed within a ring disposed proximate said inlets of said first and second fuel mixing passages.

11. The combustor according to claim 10, wherein said ring is disposed between said inlets of said first and second fuel mixing passages.

12. The combustor according to claim 1, wherein said annular fuel distribution chamber is formed within a ring disposed adjacent said wall member.

13. A combustor for combusting a fuel in a flow of oxygen bearing fluid comprising:

a) first and second mixing passages for mixing first and second portions of said fuel in first and second portions of said flow of oxygen bearing fluid, respectively, said first mixing passage having an inlet for receiving said first portion of said oxygen bearing fluid flow, said second mixing passage having an inlet for receiving said second portion of said oxygen bearing fluid flow and said first and second mixing passages being separated by a wall member that isolates the first portion of the oxygen bearing fluid in the first passage from the second portion of the oxygen bearing fluid in the second passage; and b) an annular fuel distribution ring disposed proximate said first and second passage inlets and positioned in the flow of oxygen bearing fluid upstream of said wall member, said fuel distribution ring having (i) an interior portion forming first and second, separate fuel distribution manifolds, which are isolated from each other, and (ii) first and second rows of fuel discharge ports, said first row of fuel discharge ports in flow communication with said first fuel distribution manifold and located so as to discharge said first portion of said fuel flow into only said first fuel mixing passage, said second row of fuel discharge ports in flow communication with said second fuel distribution manifold and located so as to discharge said second portion of said fuel flow into only said second fuel mixing passage.

14. The combustor according to claim 13, further comprising fuel flow supply means for supplying said first and second portions of said fuel flow to said first and second fuel distribution manifolds, respectively.

15. The combustor according to claim 14, wherein said fuel flow supply means comprises means for separately regulating the flow rate of said first portion of said fuel flow supplied to said first fuel distribution manifold and the flow rate of said second portion of said fuel flow supplied to said second fuel distribution manifold.

16. The combustor according to claim 14, wherein said fuel flow supplying means further comprises an annular fuel supply chamber in flow communication with said first and second fuel distribution manifolds.

17. The combustor according to claim 16, wherein said annular fuel supply chamber is formed within a ring having an interior portion forming first and second fuel supply manifolds, and wherein said fuel flow supplying means further comprises means for directing said first portion of said fuel flow from said first fuel supply manifold to said first fuel distribution manifold and means for directing said second portion of said fuel flow from said second fuel supply manifold to said second fuel distribution manifold.

* * * * *